US007930791B1

(12) United States Patent
Morad

(10) Patent No.: US 7,930,791 B1
(45) Date of Patent: Apr. 26, 2011

(54) MOP HAVING REMOVABLE AND ROTATABLE CLAMP MEMBERS TO RETAIN YARN, THE CLAMP MEMBERS ALSO RETAINING ADDITIONAL CLEANING MEMBERS

(75) Inventor: Fred I. Morad, Toluca Lake, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 790 days.

(21) Appl. No.: 12/005,227

(22) Filed: Dec. 24, 2007

(51) Int. Cl.
*A47L 13/12* (2006.01)
*A47L 13/144* (2006.01)

(52) U.S. Cl. ..... 15/115; 15/116.2; 15/119.2

(58) Field of Classification Search ..... 15/115, 15/116.2, 119.2
See application file for complete search history.

(56) References Cited

U.S. PATENT DOCUMENTS 2,196,365 A * 4/1940 Schulman ..... 15/153
6,941,608 B1 9/2005 Morad et al.
7,398,576 B2 * 7/2008 Horian ..... 15/116.2

* cited by examiner

*Primary Examiner* — Monica S Carter
*Assistant Examiner* — Stephanie Newton
(74) *Attorney, Agent, or Firm* — Thomas I. Rozsa

(57) ABSTRACT

An improved deck mop to retain yarn comprising an elongated rod having an upper section and a lower section. An exterior rotatable sleeve threadedly surrounds the lower section which includes an interior movable piston which is further connected to a stationary spring. The lower section at its bottom end is connected to a first and second rotatable and removable clamp member comprising a respective bottom brush and bottom scrubber for cleaning. The mop through a respective clockwise and counter-clockwise rotation of the sleeve controls a respective closing and opening movement of two clamp members to thereby respectively hold or release a mop yarn, wherein the closing movement further results in contracting the spring so that the reduced spring stores a compression force having sufficient power to enable it to push the clamp members rotatably apart when the sleeve is rotated in the counter-clockwise direction.

19 Claims, 7 Drawing Sheets

MOP HAVING REMOVABLE AND ROTATABLE CLAMP MEMBERS TO RETAIN YARN, THE CLAMP MEMBERS ALSO RETAINING ADDITIONAL CLEANING MEMBERS

BACKGROUND OF THE INVENTION

1. Field of the Invention

The present invention is related to the field of mops, and more particularly is related to the field of manufacturing and assembly of deck mops which retain yarn.

2. Description of the Prior Art

Deck mops are generally well known. One major part of a deck mop is a mop yarn which is attached to a mechanism through which the mop yarn is attached. Usually the mop yarn is sewn together and thereafter is fastened to a handle by means of having a wire wrapped around the upper portion of the yarn so that it is fastened to a handle which is in usually a cylindrical stick made of wood or plastic. Alternatively, the mop yarn is sewn together and then retained by a plastic cup by which the yarn is attached to the handle.

U.S. Pat. No. 6,941,608 issued to Morad et al. on Sep. 13, 2005 for "Collar To Be Used With A Deck Mop To Retain Yarn And Connect To The Handle" discloses a novel, new and an improved attachment collar for a deck mop, by which a mop yarn can be quickly and efficiently attached together and by which the collar can be quickly and efficiently attached to a handle. However, the Morad patented mop has only one structural cleaning member which is the yarn and does not have other features to be used in other types of cleaning and scrubbing operations.

Therefore, there is a significant need to provide an improved mop which has a plurality of functioning members in addition to the cleaning the yarn to significantly improve convenience and efficiency of performing cleaning work with the mop.

SUMMARY OF THE INVENTION

The present invention is an improved deck mop to retain yarn comprising an elongated rod having an upper section and a lower section. An exterior rotatable sleeve threadedly surrounds the lower section which includes an interior movable piston which is further connected to a stationary spring. The lower section at its bottom end is connected to a first and second rotatable and removable clamp member comprising a respective bottom brush and bottom scrubber for cleaning. The mop through a respective clockwise and counter-clockwise rotation of the sleeve controls a respective closing and opening movement of two clamp members to thereby respectively hold or release a mop yarn, wherein the closing movement further results in contracting the spring so that the reduced spring stores a compression force having sufficient power to enable it to push the clamp members rotatably apart when the sleeve is rotated in the counter-clockwise direction.

The lower section of the rod is further comprised of a hollow elongated cylindrical wall having a closed bottom end, wherein a first and second longitudinal slot which are crossed by a respective first and second transverse slots are positioned through the closed bottom end to the elongated wall. The rod lower section includes within it the movable piston which is connected to the spring and is further connected to a stopper for limiting a longitudinal movement of the spring, wherein the piston is positioned adjacent the closed bottom end of the lower section when the spring is at an expanded condition.

The first and second clamp member each have a similar structure and comprise respective bottom transverse sections which can hold or release the mop yarn when two bottom transverse sections are in their respective closed or opened positions. The first and second bottom transverse sections are further connected to respective longitudinal top force applying strips having respective reduced top opened ends, wherein the longitudinal strips are further each connected to respective transverse rotational axles.

The first and second clamp members are installed into the rod lower section after the respective longitudinal force applying strips which are transversely connected to their respective transverse axles are positioned into the respective elongated slots which are transversely connected to the respective transverse slots, wherein the top ends of the respective longitudinal strips are pushed by the piston which is powered by the expanded spring so that two top ends are rotatably close towards each other which causes the respective bottom transverse sections of the clamp members are spread apart from each other thereby to release the yarn.

The sleeve when rotated downward in a clockwise direction forces the respective clamp members to rotatably close towards each other to thereby hold the yarn. The inward movement of the clamp members makes their respective top ends of the respective force applying strips move outwardly and upwardly apart from each other, wherein the moving ends press the piston which makes it have an upward movement. The upwardly moving piston further contracts the spring. Therefore, the spring preserves a compression force power to drive the clamp members rotatably apart from each other to an open position when the sleeve is rotated in a counter-clockwise direction.

The uniqueness of the present invention is to provide a combination deck mop which can removably retain a multiplicity of yarn between two clamping jaws in combination with a cleaning brush incorporated into one of the jaws and a scrubber or wiper incorporated in the other jaw. The jaws are respectively attached to a mechanism which is rotatably connected to a spring loaded piston. An outer sleeve or collar when rotated in one direction forces the two jaws together and overcomes the spring force so that the jaws are locked to retain mop yarn between them. This also causes the spring to be compressed and store a compression force. When the sleeve is rotated in the opposite direction, the piston is pushed in the opposite direction by the force of the spring and the jaws are spread apart to thereby release the yarn. The brush incorporated into one of the jaws and the scrubber incorporated into the other of the jaws facilitates multipurpose cleaning of surfaces including mopping the surface, scrubbing off difficult to remove dirt and brushing the dirt away.

It is an object of the present invention to construct an improved deck mop comprising an elongated rod having an upper section and a lower section. An exterior rotatable sleeve threadedly surrounds the lower section which in turn includes an interior movable piston which is further connected to a stationary spring. The lower section at its bottom end is connected to a first and second rotatable and removable clamp member which in turn respectively retain a brush and a scrubber. The mop through a respective clockwise and counter-clockwise rotation of the sleeve controls a respective closing and opening movement of two clamp members to thereby respectively hold or release a mop yarn between the clamp members, wherein the closing movement further results in contracting the spring so that the compressed spring stores a power which enables it to push the clamp members rotatably apart when the sleeve is rotated in a counter-clockwise direction.

It is also an object of the present invention to construct a lower section of the rod which is further comprised of a hollow elongated cylindrical wall having a closed bottom end, wherein a first and second longitudinal slot which are crossed by a respective first and second transverse slot are positioned through the closed bottom end to the elongated wall. The interior of the rod lower section includes the movable piston which is connected to the spring and further connected to a stopper for limiting a longitudinal movement of the spring, wherein the piston is positioned adjacent the closed bottom end of the lower section when the spring is at an expanded condition.

It is an additional object of the present invention to incorporate first and second clamping members having a similar structure to comprise respective bottom transverse sections which can retain yarn between the jaws of the clamping members when in the closed position and release the yarn when the jaws are in the opened position. The outer respective sides of the clamping jaws respectively retain a brush and a scrubber.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is an improved deck mop comprising an elongated rod having an upper section and a lower section. The exterior surface of the lower section threadedly attaches to the interior of an exterior rotatable sleeve. The interior of the lower section, retains an interior longitudinally movable piston which is further connected to a spring, and at a bottom end connects to a first and second clamp member which at their bottom sides contains a respective bottom brush and bottom scrubber for cleans a surface such as a floor. Through a respective counterclockwise and clockwise rotation of the exterior sleeve, the two clamp members are respectively rotatably opened and closed to thereby respectively release or hold the mop yarn, wherein the closing movement further results in compressing the spring which enables it to store energy to provide a spring force to push the clamp members apart when the sleeve is rotated in the counterclockwise direction.

Figure 1:
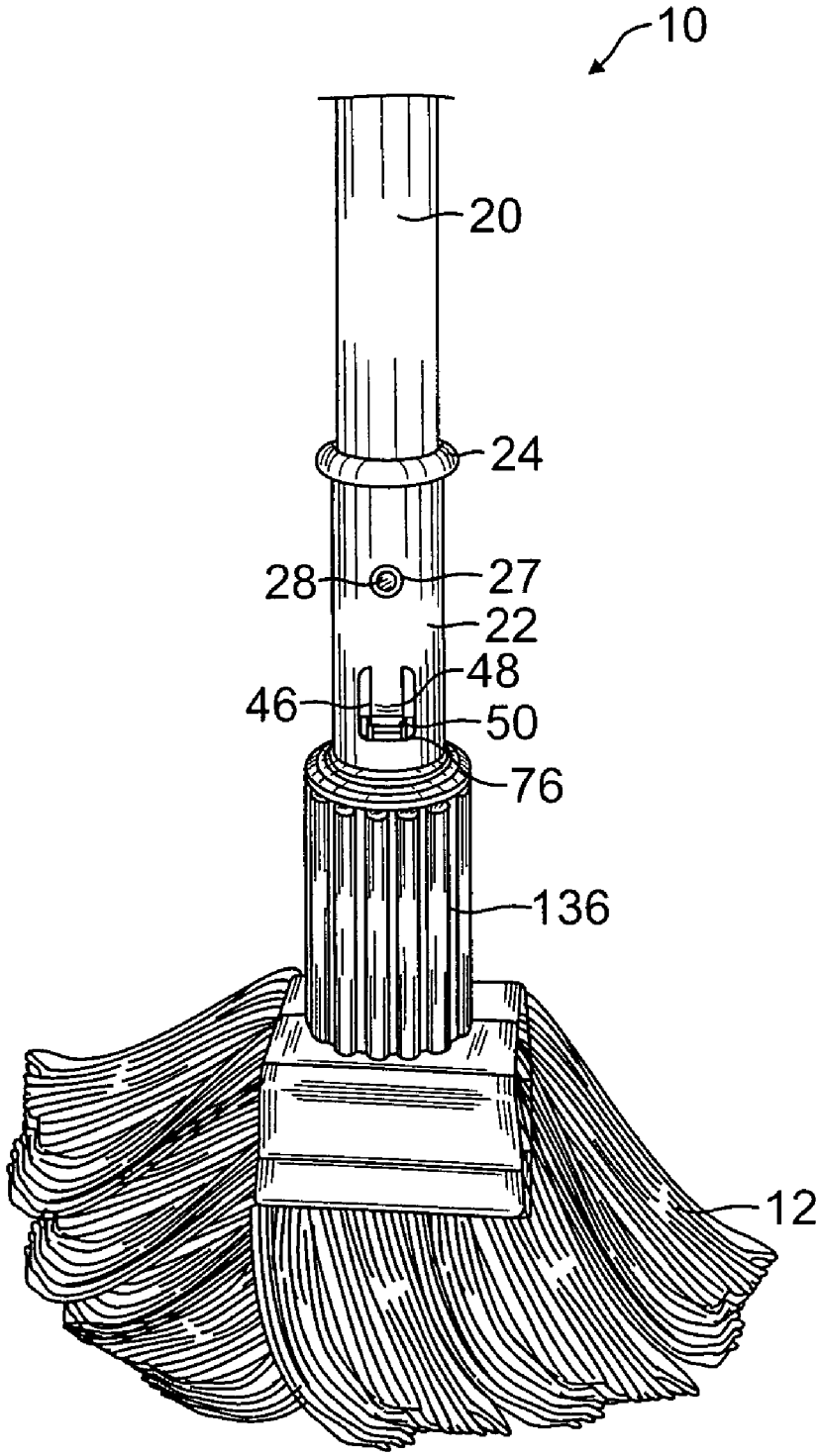
FIG. 1 is a front perspective view of a fully assembled improved deck mop of the present invention, where the mop yarn is retained by a pair of closed clamp members which in turn is attached to the mop rod.
Figure 2:
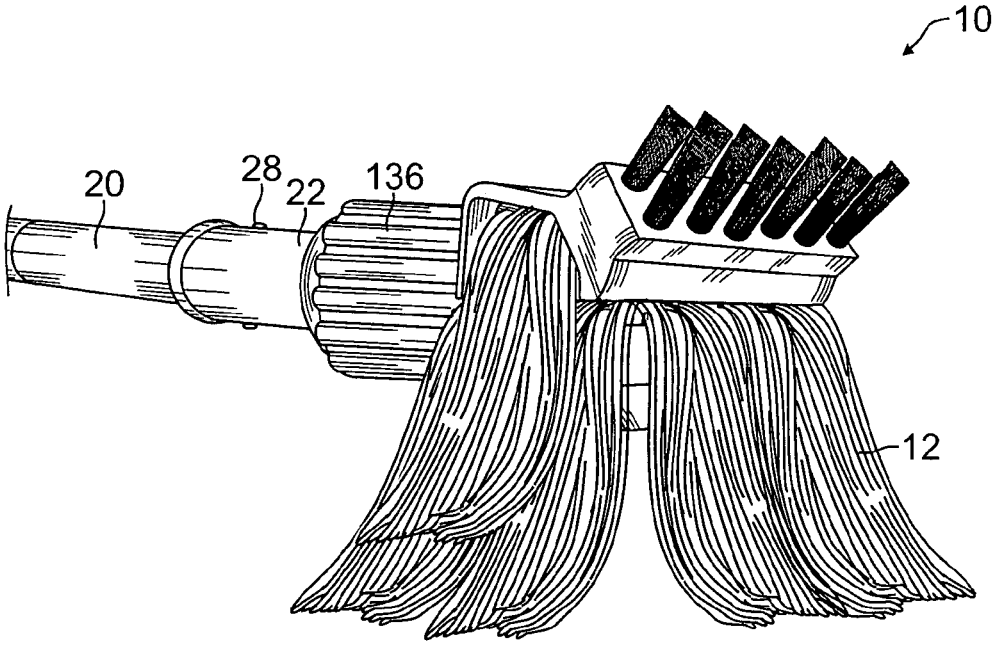
FIG. 2 is a perspective bottom side view of the fully assembled improved deck mop of the present invention, wherein two clamp member are at a closed position to hold a yarn.

Referring to FIGS. 1-6B, there is illustrated present invention improved deck mop 10, comprising of two functional structure groups, a mop handle and a bottom structure for a respective holding and cleaning function. As illustrated in FIG. 1, a handle of the improved mop is comprised of an upper section 20 and a lower section 22, wherein a lower end of the upper section 20 is inserted into the lower section 22. As illustrated, they are further fastened by a fastening member 28.

Figure 5A:
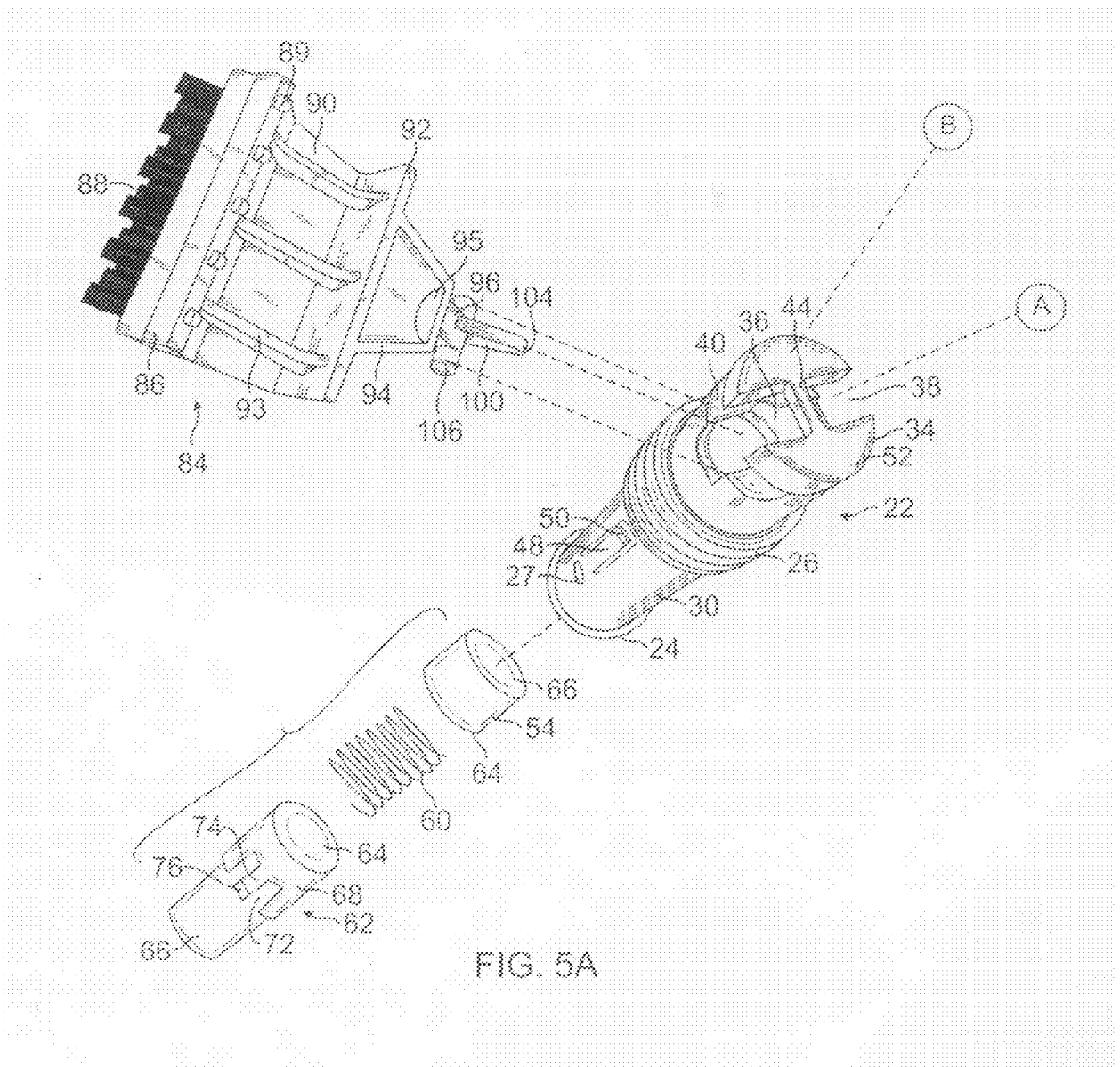
FIG. 5A is a perspective exploded view to illustrate primary structural components of a lower part of the improved mop.
Figure 6A:
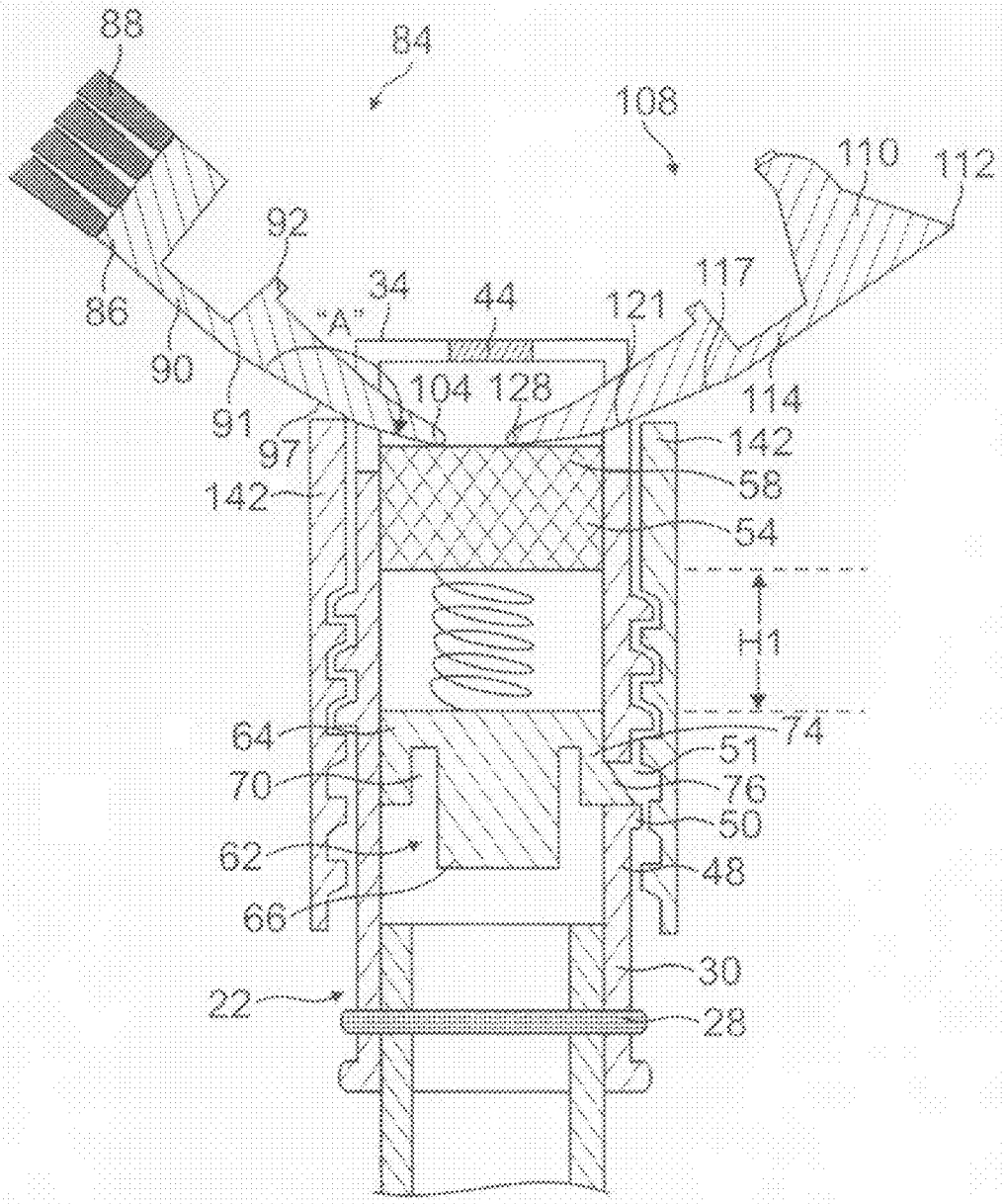
FIG. 6A is a cross-sectional view which illustrates an opening mechanism for the two clamp members of the improved mop, to illustrated how the clamp members can be opened in accordance with the present invention.
Figure 6B:
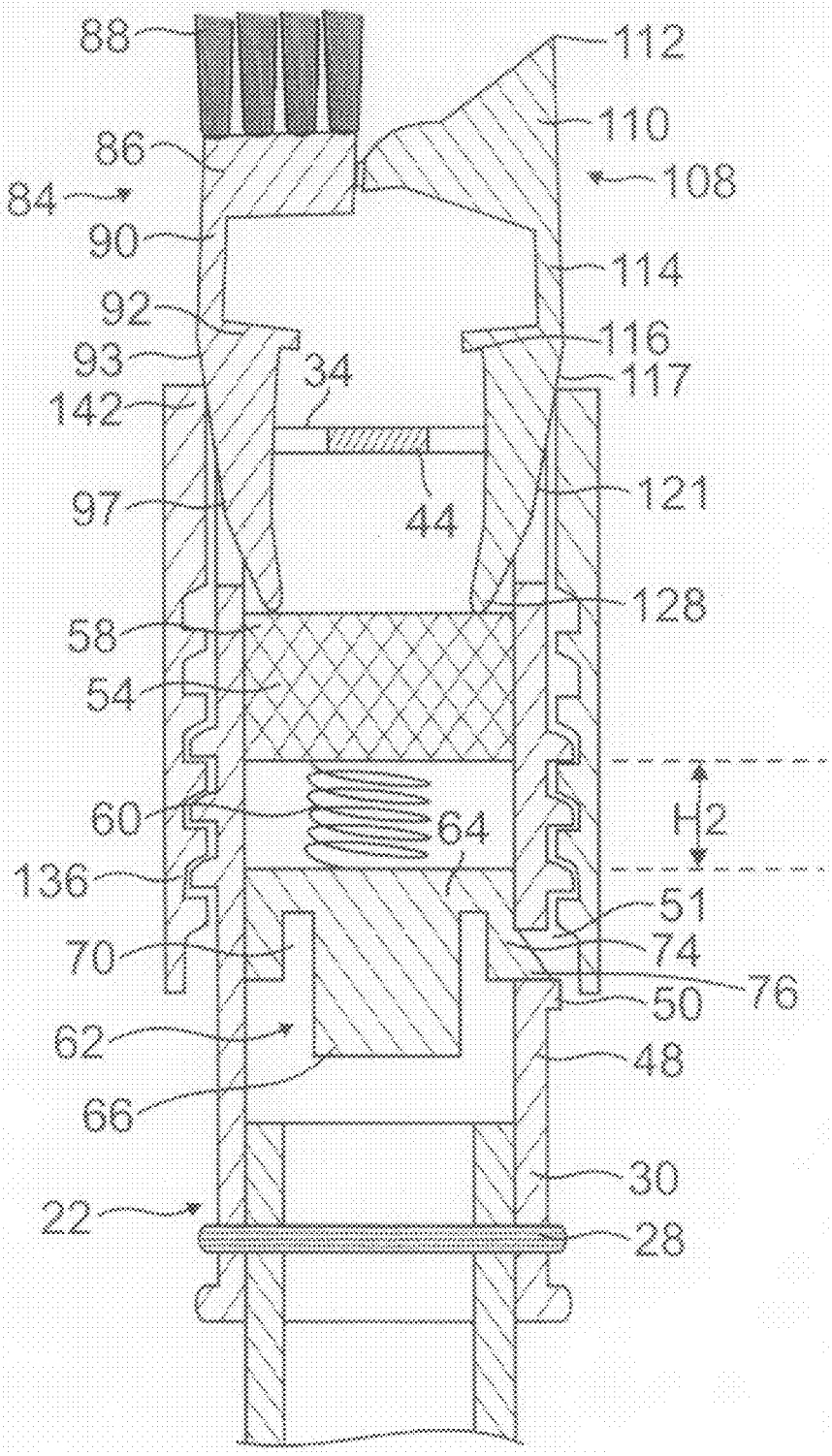
FIG. 6B is a cross-sectional view which illustrates a closing mechanism for the two clamp members of the improved mop, to illustrated how the clamp members can be closed in accordance with the present invention.

Referring to FIGS. 5A and 6B there is illustrated the bottom structure which retains cleaning members of the mop 10. The group is comprised of a first and second removable and rotatable clamp member 84 and 108 for holding or releasing a mop yarn 12, a piston assembly and an exterior sleeve 136. The piston assembly is further comprised of a piston 54, a spring 60 and a stopper 62, which are all positioned inside of the lower section 22 of the handle.

Referring to FIGS. 1 and 5A, the handle is illustrated to be an, elongated hollow rod, having the upper section 20 which is significantly longer than the lower section 22. The handle lower section 22 is comprised of a hollow cylindrical wall 30 having an upper end 24 and a lower end 34. As illustrated, one end of the upper section 20 of the handle is pressed to fit into the upper end 24 of the wall 30 of the lower section 22, and further fastened by the fastening member 28. It will be appreciated that through this affixation, the fastening member 28 penetrates through an opening 27 adjacent the upper end 24 of the wall 30 and extends through the respective holes on the end of the upper section 20 of the handle.

As illustrated, below the opening 27, the cylindrical wall 30 of the handle lower section 20 contains a rectangular window 46, where its elongated direction is longitudinally aligned with the opening 27. Within the window, there is an elongated flexible limiting member 48 having an opened lower end 50. The member 48 at the opposite end is affixed to a transverse upper side of the window. The limiting member 48 is also positioned to longitudinally align with the elongated direction of the window 46 and further align with the opening 27 on the cylindrical wall 30. In this configuration, there is a space 51 between the opened lower end 50 of the limiting member 48 and a transverse lower side of the window 46. As further illustrated, the flexible limiting member 48 is specifically designed to have an outwardly extended shoulder at the opened end 50, where the end 50 limits a position for the stopper 62 which is installed inside of the lower section 22 of the handle.

Below the window 46, the cylindrical wall 30 of the handle lower section has exterior spiral threads 26 which transversely surround approximately a middle of the elongated wall 30. It will be appreciated that the threads 26 are used for fastening the exterior cylindrical sleeve 136, which includes interior threads 134 to match the exterior threads 26 of the lower section 22 of the handle.

Further below the exterior threads 26, there is a lower end 34 of the cylindrical wall 30, which serves as a joint for removably attaching two rotatable clamp members 84 and 108. As further illustrated, the lower end 34 is comprised of a transverse bottom plate 52. However, the bottom plate 52 is divided by an identical first and second longitudinal slot 36 and 38 to form an identical first and second segment.

The segments are mirror images of each other relative to a first diameter of the plate 52. The segments are further connected to each other by a transverse beam 44 which is aligned with a second diameter of the bottom plate 52 for strengthening the lower end 34 of the handle lower section 22, wherein the second diameter is perpendicular to the first diameter.

As additionally illustrated, the first and second slots 36 and 38 are centered to align with the first diameter of the bottom plate 52. The first and second elongated slots 36 and 38 further extend longitudinally along the cylindrical wall 30 to a location close to the exterior threads 26. In addition, a first transverse slot 40 on the wall 30 intercepts a middle of the first longitudinal slot 36, wherein the transverse slot 40 is orientated in parallel with the transverse beam 44. Similarly as a mirror image of the first transverse slot 40, a second transverse slot on the wall 30 intercepts a middle of the second longitudinal slot 38. It will be appreciated that the first and second transverse slots 40 and 42 serve as the respective rotational axes for the first and second rotatable clamp member 84 and 108.

Referring to FIG. 5A, there is illustrated stopper 62, comprising a round bottom end 64 which has a diameter to match an interior diameter of the cylindrical wall 30 of the handle lower section 22. The round bottom end 64 at the center of its opposite side is concentrically connected to a round solid cylinder having an opened end which acts as a top end 66 of the stopper 62, wherein the diameter of the bottom end 64 is larger than the diameter of the top end 66. In addition, a cylindrical wall 68 having an upper opened circular edge is also concentrically connected to the circumference of the bottom end 64, which constructs a circular slot 31 between the central cylinder and the outer cylindrical wall 68 of the stopper 62. A plurality of elongated slots 72 wherein each has an opened end are circumferentially spaced on the cylindrical wall 68, so that the cylindrical wall is divided by the slots into a plurality of strips wherein each has an opened upper end on the upper opened circular edge of the wall 68 and a closed end adjacent the bottom end 64 of the stopper 62.

As further illustrated, one of the strips which serves as a position limiting member 74 is comprised of an outwardly extended top end 76. The diameter of the outwardly extended top end 76 is larger than the interior diameter of the handle lower section 22. It will be appreciated that, from the present invention, the outwardly extended top end 76 of the position limiting member 74 matches the outwardly extended shoulder end 50 of the elongated flexible limiting member 48 of the handle lower section 22. This enables the stopper 62 to be affixed after the stopper is inserted into the handle lower section 22, where the outwardly extended top end 76 of the stopper 62 is locked by the outwardly extended shoulder end 50 of the flexible limiting member 48 which is positioned inside of the window 46 of the lower section 22 of the handle.

In addition to the stopper 62 as one component of the piston assembly, FIG. 5A also illustrates the rest of the assembly, comprising the spring 60 and the cylindrical piston 54 having a top end 64 and a bottom end 66, wherein the diameter of the piston 54 matches the interior diameter of the lower section 22 of the handle.

The above illustration discloses an embodiment of structure to affix the stopper 62 inside of the lower section 22 of the handle. However, many variations of the structure are readily available and are within the spirit and scope of the present invention. For example, instead of having the disclosed structure of the window 46 and stopper 62, an alternative embodiment could be having a round plate or plug installed inside of the handle lower section 22 to limit a position of the spring 60. The round plate or plug is affixed to the lower section by a transverse fastening member which penetrates through the handle lower section of the handle and the plate or plug.

Figure 3:
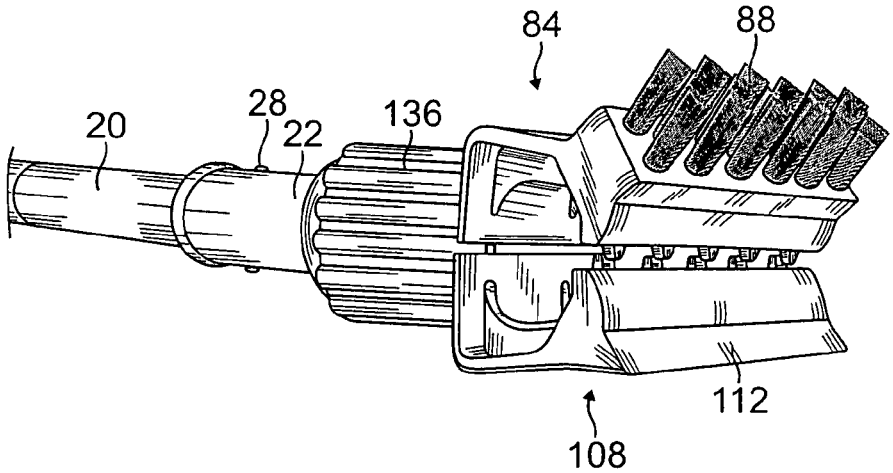
FIG. 3 is a perspective bottom side view of the present invention deck mop with the yarn removed and in the closed position to illustrate additional structural members including a brush and scrubber, which are positioned on respective bottoms of the respective clamp members of the improved mop.
Figure 4:
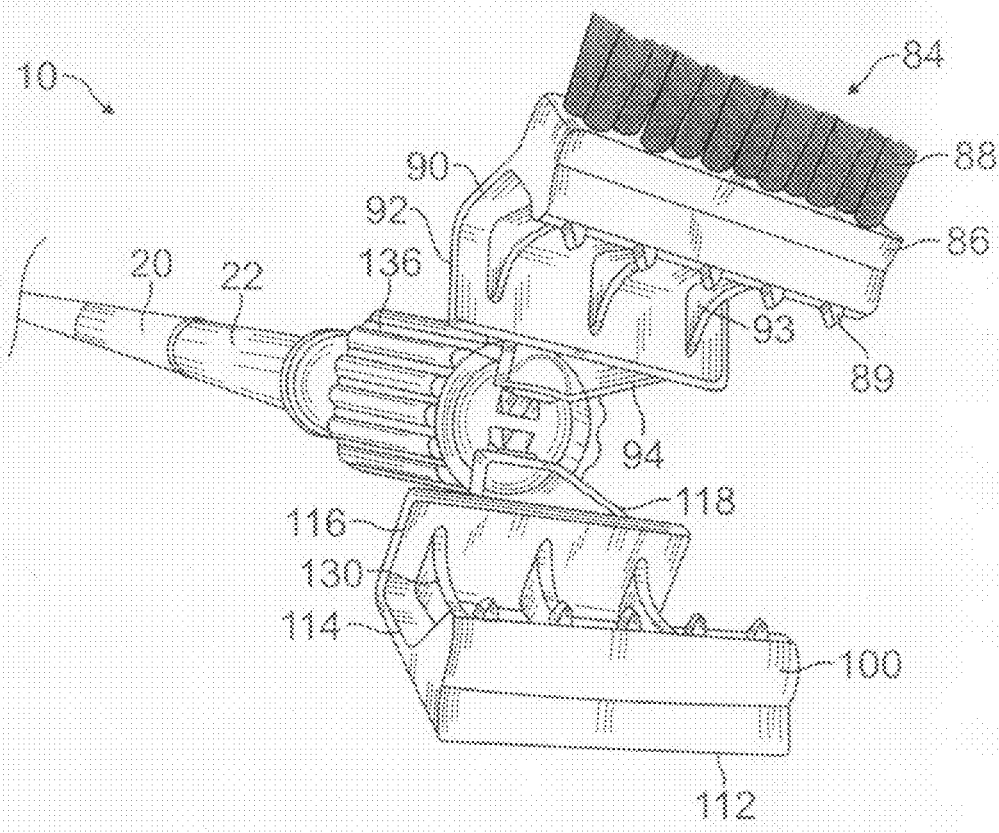
FIG. 4 is a perspective bottom side view of the present invention deck mop with the yarn removed and in the opened position to illustrate additional structural members including a brush and scrubber, which are positioned on respective bottoms of the respective clamp members of the improved mop.

Referring to FIGS. 3 and 5A there is illustrated the first clamp member 84, comprising a bottom transverse section 86 having a plurality of brushes 88. A plurality of fastening means such as teeth 89 are positioned at an inward edge of the bottom transverse section 86. The bottom transverse section 86 is connected to a connecting wall 90 which is further connected to a transverse plate 92. In addition, a plurality of elongated strengthening beams 93 are longitudinally connected to the bottom transverse section 86, the connecting wall 90 and the transverse plate 92 for enhancing the mechanical strength of these components.

The first clamp member 84 further includes a connecting member 94, preferably consisting of a gradually reduced upward arcuate wall having an exterior surface 91, where the wall is aligned with the elongated direction of the mop. The wall at its lower wide edge is connected to a middle of the transverse plate 92, and is at the upper reduced edge is connected to connect a flat transverse segment 95.

As illustrated, a flat and short connecting shoulder 96 is comprised of an exterior rear side 97, an extended and reduced top end, and the opposite bottom end. The shoulder 96 at the opposite bottom end is upwardly connected to the transverse flat segment 95. The short connecting shoulder 96 is further illustrated at its reduced top end to connect a force applying strip 100 having a reduced top end 104. In addition, the force applying strip 100 is at an angle "A" of about 135 degrees, which is better illustrated in FIG. 6B, to connect to the flat connecting shoulder 96 where the connection takes place from the top end of the shoulder 96 to extend close to a flat edge of the segment 95.

Referring to FIG. 5A, there is illustrated that a first transverse rotational axle 106 which is centrally connected at its middle position to a joint where the flat shoulder 96 is connected to the force applying strip 100. It will be appreciated that, the first transverse rotational axle 106 serves as a rotating means for the first rotatable clamp member 84 after installation of the first rotational axle 106 into the first transverse slot 40 at the lower section 22 of the handle.

Figure 5B:
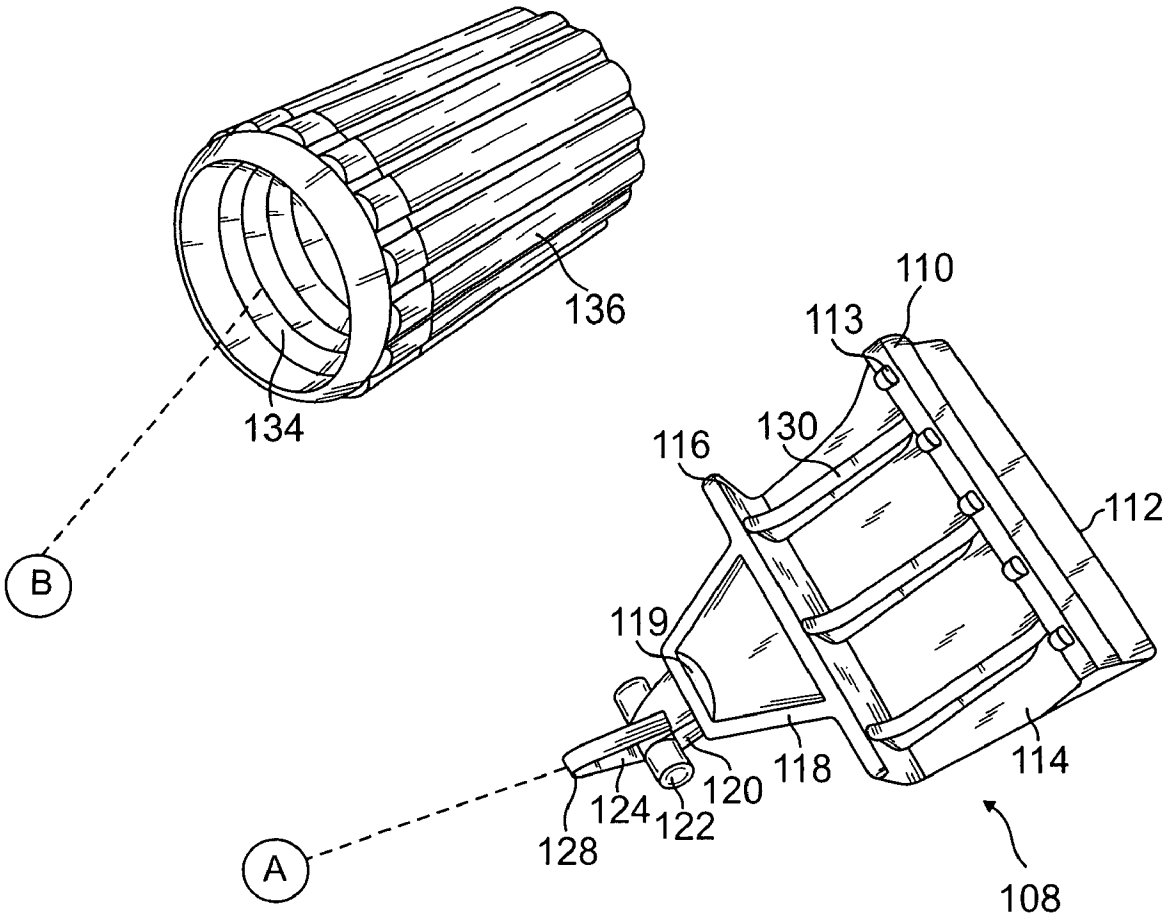
FIG. 5B is also an perspective exploded view, which continues from FIG. 5A to illustrate additional components of the lower part of the improved mop.

As particularly illustrated in FIG. 5B, the second removable and rotatable clamp member 108 has an identical structure to the first clamp member 84, except for having the bottom brushes. In stead, the second clamp member 108 is comprised of a bottom curved transverse edge 112 which serves as a scrubber or wiper. Therefore, the second clamp member 108 is additionally comprised of a bottom section 110 having the transverse edge 112, a plurality of fastening means such as teeth 113, a connecting wall 114, a transverse base plate 116, a plurality of elongated strengthening beams 130, a connecting member 118 having an exterior surface 117, a transverse segment 119, a flat connecting shoulder 120 having an exterior rear side 121, a transverse rotating axle 122, and an upward force applying strip 124 having a top end 128.

In assembling the present invention deck mop 10, it will be appreciated that the piston assembly is first assembled. The piston 54 is inserted into the hollow cylindrical wall 30 of the handle lower section 22, wherein its bottom end 58 is towards the bottom end 34 of the lower section. After insertion of the spring 60, the stopper 62 is then inserted into the lower section 22, wherein its bottom end 66 is towards the bottom end 34 of the lower section, and the side flexible limiting member 74 of the stopper 62 is aligned with the flexible limiting member 48 which is placed inside of the window 46 of the lower section 22 of the handle.

It will be appreciated that because of existence of the open ended slots 72 and the circular gap 70, the side limiting member 74 is flexible so that the outwardly extended top end 76 of the member 74 is inwardly bent inside of the hollow cylindrical wall 30 of the lower section 22 before it reaches the space 51 of the window 46 during its insertion into the lower section. Therefore, as illustrated in FIGS. 6A and 6B, the outwardly extended top end 76 of the side limiting member 74 of the stopper 62 moves outwardly to occupy the space 51 after passing the lower end 50 of the flexible limiting member 48 of the window 46. In this setting, the flexible limiting member 48 locks the side limiting member 74 of the stopper, so that the position of the stopper 62 is affixed inside of the lower section 22 of the handle.

After completion of assembling the piston assembly and threadedly connecting the exterior cylindrical sleeve 136 onto the cylindrical wall 30, the first and second rotatable clamp member 84 and 108 are installed into the lower end 34 of the handle lower section 22, wherein the bottom end 142 of the sleeve 136 is positioned higher than the bottom plate 52 of the cylindrical wall 30.

Referring to FIGS. 6A and 6B, there is illustrated the mechanism of the present invention deck mop 10 from which two rotatable clamp members 84 and 108 can be controlled into an opened or a closed position for respectively holding or releasing the mop yarn 12.

As illustrated in FIG. 6A, the first clamp member 84 is installed so as to be aligned and extend in a leftward direction, where the transverse rotational axle 106 is placed inside of the first transverse slot 40. The flat connecting shoulder 96 connected to the force applying strip 100 of the first clamp member 84 is inserted towards the first elongated slot 36, wherein the force applying strip 100 is inserted into the slot 36 so that the top end 104 touches the bottom side 58 of the piston 54. Similarly, the second clamp member 108 is installed where its transverse rotational axle 122 is placed inside of the second transverse slot 42 of the handle lower section 22 and the top end 128 of the force applying strip 124 is placed to contact the bottom side 58 of the piston 54.

In this setting the first clamp member 84 is positioned aligned with the upper-left direction and the second clamp member 108 is aligned with the upper-right orientation, so that the clamp members 84 and 108 are wide opened. Further in this setting, the spring 60 of the piston assembly is at its maximumly expanded condition to have a height as the illustrated "H1". Accordingly the piston 54 is pushed into a lowest longitudinal position.

As illustrated in FIG. 6B, during rotation of the exterior sleeve 136 when it is rotated in the clockwise direction towards the bottom end 34 of the handle lower section 22, the bottom circular edge 142 of the sleeve 136 having the downward movement simultaneously and inwardly pressed the respective rear exterior sides 97 and 121 of the respective flat connecting shoulders 96 and 120 of the respective first and second clamp members, 84 and 108. This makes the respective bottom transverse sections 86 and 110 of the respective clamp members rotate inwardly around the respective first and second transverse slots 40 and 42 towards their closed position. Concurrently, it makes the respective top ends 104 and 128 of the respective force applying strips 100 and 124 of the respective clamp members move upwardly and outwardly. Therefore, the top ends 104 and 128 of the force applying strips 100 and 124 press the piston 54, which makes it have an upward movement. The piston upward movement in turns contracts the spring 60.

While continually rotating of the sleeve 136, the bottom circular edge 142 moves down to press the respective exterior rear sides 91 and 117 of the respective connecting members 94 and 118 of the respective clamp members 84 and 108.

As illustrated in FIG. 6B, when the sleeve 136 is maximumly rotated down, it completely closes the first and second clamp members so that the teeth 89 and 113 of the respective first and second clamp members 84 and 108 contact each other. In this situation, the spring 60 is maximumly contracted having the minimum height "H2". It will be appreciated that during their inward movement, the clamp members hold the yarn 12 tightly if the yarn is placed between them, wherein a tightness of holding the yarn can be controlled by a longitudinal position of the sleeve 136 which is rotatably positioned.

Oppositely, if the exterior sleeve 136 is rotated counterclockwise, the contracted spring 60 expands, which pushes the piston 54 to have a downward movement. Therefore, the downwardly moving piston 54 forces the clamp members 84 and 108 to rotate, wherein the top ends 104 and 128 of the respective force applying strips 100 and 124 have a downward and inward movement. This causes the respective bottom sections 86 and 110 of the respective clamp members 84 and 108 to move outwardly to be in an opened position so that the mop yarn 12 can be released when the clamp members are opened widely enough.

The above disclosure illustrates a preferred embodiment of the present invention, comprising the first and second clamp member 84 and 108 and corresponding longitudinal and transverse slots, wherein both clamp members are removable and rotatable. However, according to the principles and spirit of the present invention, another embodiment is also readily available. The embodiment is comprised of at least one removable and rotatable clamp member which is combined with a corresponding at least one longitudinal and transverse slots and a counter member of the at least one removable and rotatable clamp member which is a stationary one. The embodiment is also appropriate for holding or releasing the mop yarn 12, in addition to include a plurality of structure for multiple cleaning functions.

Defined in detail, the present invention is an improved mop for retaining yarn, comprising: (a) a handle having an upper section and a lower section, the lower section comprised of a hollow cylindrical wall having an upper end and a lower end, wherein a window is positioned below the upper end of said wall, and exterior spiral threads are positioned on the wall and below the window, said lower end is comprised of a transverse bottom plate which is divided by an identical first and second longitudinal slot to form an identical first and second segment which are connected to each other by a transverse beam, said first and second slots forming elongated slots extending longitudinally along the cylindrical wall to a location close to said exterior threads, wherein a first transverse slot on the wall intercepts the first elongated slot, and a second transverse slot on the wall intercepts the second elongated slot; (b) a sleeve having interior threads rotatably surrounding said lower section of said handle; (c) a piston assembly which is positioned inside of the said handle lower section comprising a piston, a spring and a stopper, the piston is positioned close to the lower end of said lower section, said spring is positioned so that opposite ends respectively contact said piston and stopper, a position of said stopper is affixed by said window of said lower section; (d) a first and second clamp member comprising the respective upper and lower section, said upper section of said first clamp member comprising a first longitudinal upper end, wherein a first transverse axle is transversely connected to a position which is lower than said first upper end, said lower section of the first clamp member is comprised of a plurality of brushes, said upper section of said second clamp member comprising a second longitudinal upper end, wherein a second transverse axle is transversely connected to a position which is lower than said upper end, said lower section of the second clamp member further comprising a scrubber; (e) said first longitudinal upper end of said first clamp member is installed into said first longitudinal slot to contact said piston, wherein said first transverse axle is positioned inside of said first transverse slot, said second longitudinal upper end of said second clamp member is installed into said second longitudinal slot to contact said piston, wherein said second transverse axle is positioned inside of said second transverse slot; and (f) rotation of said in the clockwise directions serves to close said first and second clamp member to thereby hold the yarn between the clamp members, wherein said respective upper ends of respective first and second clamp members which rotatably move outwardly relative to each other press upwardly against said piston which presses said spring which is thereby compressed, rotation of the sleeve in the said sleeve in the counterclockwise direction opens said first and second clamp members to thereby release said yarn, wherein said respective upper ends which rotatably move inwardly to each other are pushed downwardly by said piston which is pushed by said spring which is expanding.

Also defined in detail, the present invention is an improved mop for retaining yarn, comprising: (a) a handle including a lower section, said lower section comprised of a hollow cylindrical wall having an upper end and a lower end, exterior spiral threads on the cylindrical wall, said lower end is comprised of a transverse bottom plate which is divided by an identical first and second longitudinal slot to form an identical first and second segment which are connected to each other by a transverse beam, said first and second slots forming elongated slots extending longitudinally along the cylindrical wall to a location close to said exterior threads, wherein a first transverse slot on the wall intercepts a first elongated slot, and a second transverse slot on the wall intercepts a second elongated slot; (b) a sleeve having interior threads rotatably surrounding said lower section of said handle; (c) a piston assembly which is positioned inside of the said handle lower section comprising a piston, a spring and a stopper whose position is affixed, said piston is positioned close to said lower end of said lower section, said spring is positioned so that its ends respectively contact said piston and stopper; (d) a first and second clamp member comprising respective upper and lower sections, said upper section of said first clamp member comprising a first longitudinal upper end, wherein a first transverse axle is transversely connected to a position which is lower than said first upper end, said lower section of the first clamp member is comprised of a plurality of brushes, said upper section of said second clamp member comprising a second longitudinal upper end, wherein a second transverse axle is transversely connected to a position which is lower than said upper end, said lower section of the second clamp member comprising a scrubber; (e) said first longitudinal upper end of said first clamp member is installed into said first longitudinal slot to contact said piston, wherein said first transverse axle is positioned inside of said first transverse slot, said second longitudinal upper end of said second clamp member is installed into said second longitudinal slot to contact said piston, wherein said second transverse axle is positioned inside of said second transverse slot; and (f) when said sleeve is rotated in a first direction said first and second clamp member are closed to retain yarn between the clamping members, wherein said respective upper ends of respective first and second clamp member which rotatably move outwardly away from each other press against said piston which presses said spring which is thereby compressed, and when said sleeve is rotated in an opposite direction, the clamp members are opened, wherein said respective upper ends which rotatably move inwardly toward each other are pushed downwardly by said piston which is pushed by said spring which is expanding.

Defined alternatively, the present invention is an improved mop, comprising: (a) a handle including a lower section, said lower section is comprised of a hollow cylindrical wall having an upper end and a lower end, wherein exterior spiral threads are positioned on said wall, said lower end is comprised of a transverse bottom plate which is penetrated by at least one longitudinal slot which extends longitudinally along the cylindrical wall to a location close to said exterior threads, wherein at least one transverse slot on the wall intercepts said at least one longitudinal slot; (b) a sleeve having interior threads rotatably surrounding said lower section of said handle; (c) a piston assembly which is positioned inside of the said handle lower section comprising a piston, a spring and a stopper whose position is affixed, said piston is positioned close to said lower end of said lower section, said spring is positioned to respectively contact at opposite ends said respective piston and stopper; (d) at least one clamp member which is rotatable and removable comprising an upper and a lower section, said upper section comprising a longitudinal upper end, wherein a transverse axle is transversely connected to a position which is lower than said upper end, said lower section is comprised of a structure having a cleaning function, and a counter member of said at least one clamp member which is stationary comprising a lower section having an additional clean function, (e) said first longitudinal upper end of said at least one clamp member is installed into said at least one longitudinal slot to contact said piston, wherein said first transverse axle is positioned inside of said first transverse slot; and (f) when said sleeve is rotated in one direction when at least one clamp member is closed, wherein said upper end of said at least one clamp member which rotatably moves outwardly presses upwardly said piston which presses said spring which is compressed, when said sleeve is rotated in an opposite direction said at least one clamp member is open, wherein said upper end which rotatably moves inwardly is pushed downwardly by said piston which is pushed by said spring which is expanding.

Defined more broadly, the present invention is an improved mop to retain yarn, comprising: (a) a pair of clamping jaws which have interior clamping teeth, one of the jaws having an exterior surface containing brushes and the other clamping jaw having an exterior surface containing a scrubber; (b) the pair of clamping jaws rotatably retained in a receiving member which is inserted into a sleeve retained on a mop handle, the receiving member and sleeve having engaging means by which the sleeve is rotatable relative to the receiving member, the receiving member having means by which the clamping laws are caused to rotate away from each other in an opened position when the sleeve is rotated in one direction and the clamping jaws are caused to rotate toward each other in a closed position when the sleeve is rotated in the opposite direction; and (c) the clamping jaws retaining the yarn, the yarn being inserted when the clamping jaws are in the opened position and retained when the clamping jaws are in the closed position.

Defined most broadly, the present invention is an improved mop to retain yarn, comprising: (a) a pair of clamping jaws, one of the jaws having an exterior surface containing a cleaning implement and the other clamping jaw having an exterior surface containing a cleaning implement; (b) the pair of clamping jaws rotatably retained in a receiving member which is inserted into a sleeve retained on a mop handle, the receiving member and sleeve having engaging means by which the sleeve is rotatable relative to the receiving member, the receiving member having means by which the clamping laws are caused to rotate away from each other in an opened position when the sleeve is rotated in one direction and the clamping jaws are caused to rotate toward each other in a closed position when the sleeve is rotated in the opposite direction; and (c) the clamping jaws retaining the yarn, the yarn being inserted when the clamping jaws are in the opened position and retained when the clamping jaws are in the closed position.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An improved mop for retaining yarn, comprising:

a. a handle having an upper section and a lower section, the lower section comprised of a hollow cylindrical wall having an upper end and a lower end, wherein a window is positioned below the upper end of said wall, and exterior spiral threads are positioned on the wall and below the window, said lower end is comprised of a transverse bottom plate which is divided by an identical first and second longitudinal slot to form an identical first and second segment which are connected to each other by a transverse beam, said first and second slots forming elongated slots extending longitudinally along the cylindrical wall to a location close to said exterior threads, wherein a first transverse slot on the wall intercepts the first elongated slot, and a second transverse slot on the wall intercepts the second elongated slot;

b. a sleeve having interior threads rotatably surrounding said lower section of said handle;

c. a piston assembly which is positioned inside of the said handle lower section comprising a piston, a spring and a stopper, the piston is positioned close to the lower end of said lower section, said spring is positioned so that opposite ends respectively contact said piston and stopper, a position of said stopper is affixed by said window of said lower section;

d. a first and second clamp member comprising the respective upper and lower section, said upper section of said first clamp member comprising a first longitudinal upper end, wherein a first transverse axle is transversely connected to a position which is lower than said first upper end, said lower section of the first clamp member is comprised of a plurality of brushes, said upper section of said second clamp member comprising a second longitudinal upper end, wherein a second transverse axle is transversely connected to a position which is lower than said upper end, said lower section of the second clamp member further comprising a scrubber;

e. said first longitudinal upper end of said first clamp member is installed into said first longitudinal slot to contact said piston, wherein said first transverse axle is positioned inside of said first transverse slot, said second longitudinal upper end of said second clamp member is installed into said second longitudinal slot to contact said piston, wherein said second transverse axle is positioned inside of said second transverse slot; and f. rotation of said in the clockwise directions serves to close said first and second clamp member to thereby hold the yarn between the clamp members, wherein said respective upper ends of respective first and second clamp members which rotatably move outwardly relative to each other press upwardly against said piston which presses said spring which is thereby compressed, rotation of the sleeve in the said sleeve in the counterclockwise direction opens said first and second clamp members to thereby release said yarn, wherein said respective upper ends which rotatably move inwardly to each other are pushed downwardly by said piston which is pushed by said spring which is expanding.

2. The mop in accordance with claim 1, wherein said upper and lower sections of the handle are fastened by an additional fastening means.

3. The mop in accordance with claim 1, wherein said window is rectangular and whose elongated direction is longitudinally aligned with an orientation of said handle lower section, wherein there is an elongated flexible limiting member which is positioned to align with the elongated direction of said lower section having an opened lower end attached by an outward shoulder, said member at its opposite end is affixed to a transverse upper side of said window so that there is a space between said opened lower end and a transverse lower side of said window, and said elongated flexible limiting member serves to affix said stopper.

4. The mop in accordance with claim 3, wherein said stopper further comprises a round bottom end which at the center of its opposite side of said bottom end is concentrically connected to a round solid cylinder having an opened end, a cylindrical wall having an upper opened circular edge connected to a circumference of said bottom end to thereby construct a circular slot between said central cylinder and said outer cylindrical wall, wherein a plurality of elongated slots which each has one opened end are circumferentially spaced on said cylindrical wall, which divide said wall into be a plurality of strips where each has an opened upper end on the upper opened circular edge of said wall.

5. The mop in accordance with claim 4, wherein one of said strips of said stopper comprises an outward shoulder at said upper opened end, which is positioned into said space of said window of said handle lower section so that a position of said stopper is affixed inside of said handle lower section.

6. The mop in accordance with claim 1, wherein said mop is made with durable plastics.

7. The mop in accordance with claim 1, wherein said upper sections are connected to said respective lower sections of the respective clamp members at a preferred angle of 135 degrees.

8. An improved mop for retaining yarn, comprising:

a. a handle including a lower section, said lower section comprised of a hollow cylindrical wall having an upper end and a lower end, exterior spiral threads on the cylindrical wall, said lower end is comprised of a transverse bottom plate which is divided by an identical first and second longitudinal slot to form an identical first and second segment which are connected to each other by a transverse beam, said first and second slots forming elongated slots extending longitudinally along the cylindrical wall to a location close to said exterior threads, wherein a first transverse slot on the wall intercepts a first elongated slot, and a second transverse slot on the wall intercepts a second elongated slot;

b. a sleeve having interior threads rotatably surrounding said lower section of said handle;

c. a piston assembly which is positioned inside of the said handle lower section comprising a piston, a spring and a stopper whose position is affixed, said piston is positioned close to said lower end of said lower section, said spring is positioned so that its ends respectively contact said piston and stopper;

d. a first and second clamp member comprising respective upper and lower sections, said upper section of said first clamp member comprising a first longitudinal upper end, wherein a first transverse axle is transversely connected to a position which is lower than said first upper end, said lower section of the first clamp member is comprised of a plurality of brushes, said upper section of said second clamp member comprising a second longitudinal upper end, wherein a second transverse axle is transversely connected to a position which is lower than said upper end, said lower section of the second clamp member comprising a scrubber;

e. said first longitudinal upper end of said first clamp member is installed into said first longitudinal slot to contact said piston, wherein said first transverse axle is positioned inside of said first transverse slot, said second longitudinal upper end of said second clamp member is installed into said second longitudinal slot to contact said piston, wherein said second transverse axle is positioned inside of said second transverse slot; and f. when said sleeve is rotated in a first direction said first and second clamp member are closed to retain yarn between the clamping members, wherein said respective upper ends of respective first and second clamp member which rotatably move outwardly away from each other press against said piston which presses said spring which is thereby compressed, and when said sleeve is rotated in an opposite direction, the clamp members are opened, wherein said respective upper ends which rotatably move inwardly toward each other are pushed downwardly by said piston which is pushed by said spring which is expanding.

9. The mop in accordance with claim 8, further comprising a yarn which is positioned between said respective lower sections of the first and second clamp members.

10. An improved mop, comprising:

a. a handle including a lower section, said lower section is comprised of a hollow cylindrical wall having an upper end and a lower end, wherein exterior spiral threads are positioned on said wall, said lower end is comprised of a transverse bottom plate which is penetrated by at least one longitudinal slot which extends longitudinally along the cylindrical wall to a location close to said exterior threads, wherein at least one transverse slot on the wall intercepts said at least one longitudinal slot;

b. a sleeve having interior threads rotatably surrounding said lower section of said handle;

c. a piston assembly which is positioned inside of the said handle lower section comprising a piston, a spring and a stopper whose position is affixed, said piston is positioned close to said lower end of said lower section, said spring is positioned to respectively contact at opposite ends said respective piston and stopper;

d. at least one clamp member which is rotatable and removable comprising an upper and a lower section, said upper section comprising a longitudinal upper end, wherein a transverse axle is transversely connected to a position which is lower than said upper end, said lower section is comprised of a structure having a cleaning function, and a counter member of said at least one clamp member which is stationary comprising a lower section having an additional clean function, e. said first longitudinal upper end of said at least one clamp member is installed into said at least one longitudinal slot to contact said piston, wherein said first transverse axle is positioned inside of said first transverse slot; and f. when said sleeve is rotated in one direction when at least one clamp member is closed, wherein said upper end of said at least one clamp member which rotatably moves outwardly presses upwardly said piston which presses said spring which is compressed, when said sleeve is rotated in an opposite direction said at least one clamp member is open, wherein said upper end which rotatably moves inwardly is pushed downwardly by said piston which is pushed by said spring which is expanding.

11. The mop in accordance with claim 10, further comprising a yarn.

12. The mop in accordance with claim 10, further comprising a brush and wiper.

13. An improved mop to retain yarn, comprising:

a. a pair of clamping jaws which have interior clamping teeth, one of the jaws having an exterior surface containing brushes and the other clamping jaw having an exterior surface containing a scrubber;

b. the pair of clamping jaws rotatably retained in a receiving member which is inserted into a sleeve retained on a mop handle, the receiving member and sleeve having engaging means by which the sleeve is rotatable relative to the receiving member, the receiving member having means by which the clamping laws are caused to rotate away from each other in an opened position when the sleeve is rotated in one direction and the clamping jaws are caused to rotate toward each other in a closed position when the sleeve is rotated in the opposite direction; and c. the clamping jaws retaining the yarn, the yarn being inserted when the clamping jaws are in the opened position and retained when the clamping jaws are in the closed position.

14. The mop in accordance with claim 13 wherein the receiving member includes a piston and compression spring, wherein the force of rotation of the sleeve overcomes a spring force and causes the clamping jaws to be in the closed position and when the sleeve is rotated in the opposite direction, the spring force of the spring a causes the clamping jaws to rotate into the opened position.

15. The mop in accordance with claim 13 wherein the engaging means are a pair of mating threads on the receiving member and the sleeve.

16. An improved mop to retain yarn, comprising:

a. a pair of clamping jaws, one of the jaws having an exterior surface containing a cleaning implement and the other clamping jaw having an exterior surface containing a cleaning implement;

b. the pair of clamping jaws rotatably retained in a receiving member which is inserted into a sleeve retained on a mop handle, the receiving member and sleeve having engaging means by which the sleeve is rotatable relative to the receiving member, the receiving member having means by which the clamping laws are caused to rotate away from each other in an opened position when the sleeve is rotated in one direction and the clamping jaws are caused to rotate toward each other in a closed position when the sleeve is rotated in the opposite direction; and c. the clamping jaws retaining the yarn, the yarn being inserted when the clamping jaws are in the opened position and retained when the clamping jaws are in the closed position.

17. The mop in accordance with claim 16 wherein the receiving member includes a piston and compression spring, wherein the force of rotation of the sleeve overcomes a spring force and causes the clamping jaws to be in the closed position and when the sleeve is rotated in the opposite direction, the spring force of the spring a causes the clamping jaws to rotate into the opened position.

18. The mop in accordance with claim 16 wherein the engaging means are a pair of mating threads on the receiving member and the sleeve.

19. The mop in accordance with claim 16 wherein one cleaning implement is a brush and one cleaning implement is a scrubber.

* * * * *